United States Patent [19]

Hayashi et al.

[11] Patent Number: 4,959,692

[45] Date of Patent: Sep. 25, 1990

[54] DEVELOPING DEVICE WITH RETRACTABLE CUTOFF MEMBER

[75] Inventors: Yuji Hayashi; Susumu Sakakibara; Katsumi Maeda, all of Osaka, Japan

[73] Assignee: Minolta Camera Kabushiki Kaisha, Osaka, Japan

[21] Appl. No.: 282,449

[22] Filed: Dec. 9, 1988

[30] Foreign Application Priority Data

Dec. 11, 1987 [JP] Japan ..... 62-314428

[51] Int. Cl.[5] ..... G03G 15/09

[52] U.S. Cl. ..... 355/253; 118/658; 355/251

[58] Field of Search ..... 355/251, 253, 259; 118/657, 658

[56] References Cited

U.S. PATENT DOCUMENTS 4,492,456 1/1985 Haneda ..... 355/3 DD
4,746,952 5/1988 Kusuda et al. ..... 355/253

FOREIGN PATENT DOCUMENTS 54-6555 1/1979 Japan ..... 355/251
59-60453 4/1984 Japan ..... 355/251
60-140972 9/1985 Japan .
61-147274 7/1986 Japan ..... 355/251
61-170766 8/1986 Japan ..... 355/253
62-254165 11/1987 Japan ..... 355/253
63-180982 7/1988 Japan ..... 355/253

*Primary Examiner*—A. T. Grimley
*Assistant Examiner*—E. Pipala
*Attorney, Agent, or Firm*—Willian Brinks Olds Hofer Gilson & Lione

[57] ABSTRACT

A developing device including a rotatable developing sleeve confronting an electrostatic latent image support member, a supply device for supplying developer to a peripheral surface of the developing sleeve, a bristle height regulating member, a device for removing from the peripheral surface of the developing sleeve, the developer having passed through a developing region, a cutoff device for cutting off supply of the developer from the supply device to the developing sleeve, which is retractably projected into a developer supply region defined between the developing sleeve and the supply device and a magnet member provided fixedly in the developing sleeve and having a developing magnetic pole confronting the support member, a first magnetic pole confronting the bristle height regulating member and a second magnetic pole of a polarity identical with that of the first magnetic pole such that the developer is continuously held in an erect state on the developing sleeve by the first and second magnetic poles.

6 Claims, 3 Drawing Sheets

DEVELOPING DEVICE WITH RETRACTABLE CUTOFF MEMBER

BACKGROUND OF THE INVENTION

The present invention relates to a developing device for use in an image forming apparatus based on electrophotographic copying process, in which two-component developer composed of toner and carrier is used.

Conventionally, a method of performing multi-color copying is known. In this known method, an image forming apparatus in which a plurality of developing devices are provided at a side of an electrostatic latent image support member is employed such that a multicolor copy is obtained by overlapping on a transfer paper sheet, toner images formed in different colors. In the known method, in the case where an original document of three colors is copied, three copying operations are performed and thus, drive of the developing devices is required to be changed over for the colors, respectively.

Meanwhile, another prior art multi-color image forming method employs an image forming apparatus in which a plurality of developing devices are provided at a side of an electrostatic latent image support member such that the developing devices are selectively driven during one copying operation. In this prior art method, for example, a first region of the original document ranging from a front edge of the original document to a designated point is reproduced in a first color and then, a second region of the original document ranging from the designated point to a rear edge of the original document is reproduced in a second color.

In the case of the above described known multicolor image forming methods, especially, the latter one, image density at a boundary portion of the regions should be raised to a normal level instantaneously in each of the developing devices. The reason is that if a long time period is required, after start of a subsequent one of the developing devices, for stabilizing density of an image to be formed by this developing device, density of a front end portion of the corresponding copying region of the original document becomes low or nonuniform, thereby resulting in deterioration of image quality.

SUMMARY OF THE INVENTION

Accordingly, an essential object of the present invention is to provide a developing device in which a time period from start of a developing operation to start of supply of developer to a developing region is shortened.

Another important object of the present invention is to provide a developing device which is capable of performing the developing operation stably from a moment of start of the developing operation.

In order to accomplish these objects of the present invention, a developing device embodying the present invention comprises: a developing sleeve rotatably provided in the vicinity of an electrostatic latent image support member; a supply means for supplying developer to the peripheral surface of said developing sleeve; a bristle height regulating member for regulating amount of the developer transported, according to rotation of said developing sleeve, on the peripheral surface of said developing sleeve towards a developing region where said developing sleeve confronts said electrostatic latent image support member; a removal means for removing from the peripheral surface of said developing sleeve the developer having passed through the developing region; a cutoff member for cutting off supply of the developer from said supply means to said developing sleeve said cutoff member being so provided as to be retractably projected into a developer supply region defined between said developing sleeve and said supply means; and a magnet member which is fixedly provided in said developing sleeve and includes a developing magnetic pole confronting said electrostatic latent image support member, a first magnetic pole confronting said bristle height regulating member and a second magnetic pole confronting the developer supply region, said second magnetic pole having a polarity identical with that of said first magnetic pole such that the developer is continuously held in an erect state on said developing sleeve by said first and second magnetic poles.

As shown in FIG. 1, in the developing device of the above described arrangement, at the time of development, since the cutoff means 13 is retracted away from the developer supply region X, the developer supplied by the developer supply means 11 is held on the outer periphery of the developing sleeve 8 at the developer supply region X confronting the second magnetic pole N3.

Then, in order to set the developing device to a nondeveloping state, the cutoff means 13 initially proceeds to the developer supply region X so as to cut off supply of the developer to be supplied by the developer supply means 11 and the developer held on the outer periphery of the developing sleeve 8 is scraped therefrom.

Subsequently, after the developing sleeve 8 and the developer supply means 11 have been stopped, the cutoff means 13 is retracted away from the developer supply region X such that the developing device is set to the nondeveloping state. As a result, the developer which has been prevented by the cutoff means 13 from proceeding to the developing sleeve 8 is axially uniformly adsorbed by the second magnetic pole N3.

Therefore, when the developing device is set to the developing state again, the developer held by the magnetic pole N3 is carried to the developing region Y rapidly in a laterally linear state. Meanwhile, at the magnetic poles N2 and N3, since a magnetic brush of the developer is held in a substantially erect state, amount of the developer passing through an area where the developing sleeve 8 confronts the bristle height regulating member 9 becomes stable and thus, a constant amount of the developer is transported to the developing region Y.

BRIEF DESCRIPTION OF THE DRAWINGS

These objects and features of the present invention will become apparent from the following description taken in conjunction , with the preferred embodiment thereof with reference to the accompanying drawings, in which.

Before the description of the present invention proceeds, it is to be noted that like parts are designated by like reference numerals throughout several views of the accompanying drawings.

DESCRIPTION OF THE PREFERRED EMBODIMENT

Figure 1:
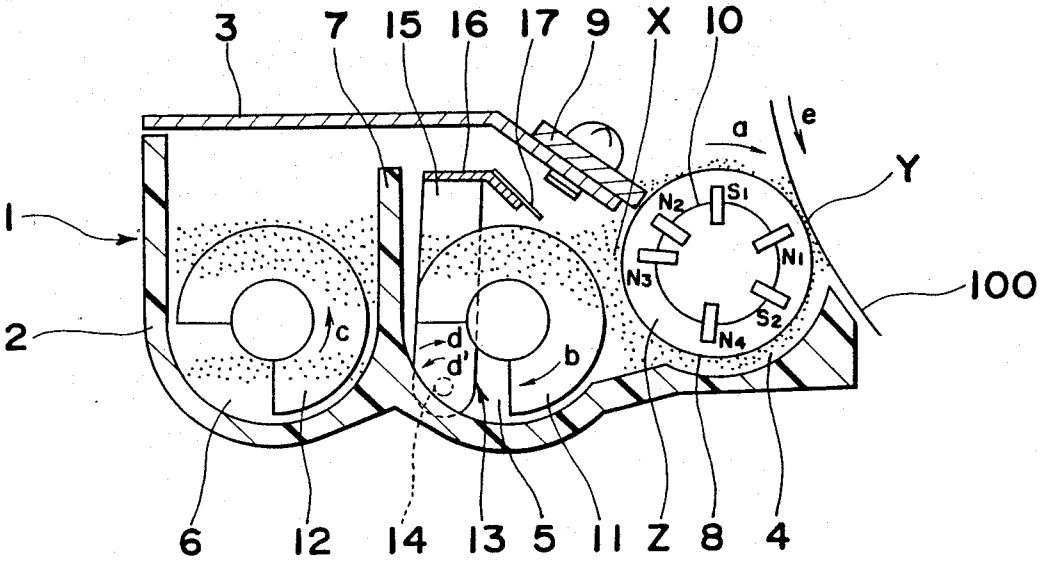
FIG. 1 is a sectional view of a developing device according to the present invention.

Referring now the drawings, there is shown in FIG. 1, a developing device 1 according to the present invention. The developing device 1 includes a casing 2, a cover 3, a developing sleeve 8, a bristle height regulating member 9 and screws 11 and 12. A developing tank is defined by the casing 2 and the cover 3. In the developing tank, a sleeve area 4 for accommodating the developing sleeve 8 and transport passages 5 and 6 are sequentially formed in a direction away from a photosensitive drum 100. The transport passages 5 and 6 are separated from each other by a partition wall 7 extending upwardly from the bottom of the casing 2 but are communicated with each other by openings (not shown) formed at both ends of the partition wall 7.

The developing sleeve 8 is rotatably provided in the sleeve area 4 so as to be driven for rotation thereof in the direction of the arrow a. A distal end of the bristle height regulating member 9, which is provided obliquely upwardly of the developing sleeve 8 and opposite to the photosensitive drum 100, confronts the developing sleeve 8 through a predetermined distance.

A magnetic member 10 is fixedly accommodated in the developing sleeve 8. The magnetic member 10 includes a plurality of axially extending magnets and magnetic poles N1 to N4 and S1 and S2 of the magnets are arranged as shown. More specifically, the N-pole N1 is provided at a portion of the magnetic member 10 confronting the photosensitive member 100 and the N-pole N2 is provided at a portion of the magnetic member 10 confronting the bristle height regulating member 9. Meanwhile, no magnet is provided at a portion of the magnetic member 10 confronting the transport passage 5 such that this portion of the magnetic member 10 acts as a non-magnetic portion Z. At a side of the magnetic member 10 upstream, in a rotational direction of the developing sleeve 8, of the N-pole N2 disposed adjacent to the bristle height regulating member 9 and at an area confronting a developer supply region X, the magnet having the N-pole N3 of a polarity identical with that of the N-pole N2 is provided.

Figure 2:
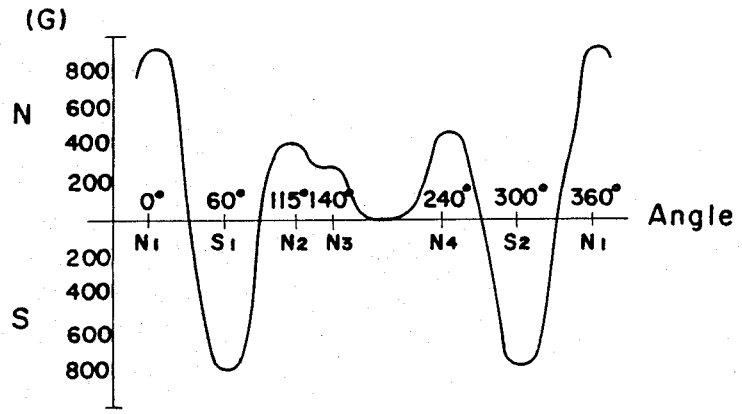
FIG. 2 is a diagram showing distribution of magnetic force of a magnetic member employed in the developing device of FIG. 1.
Figure 3:
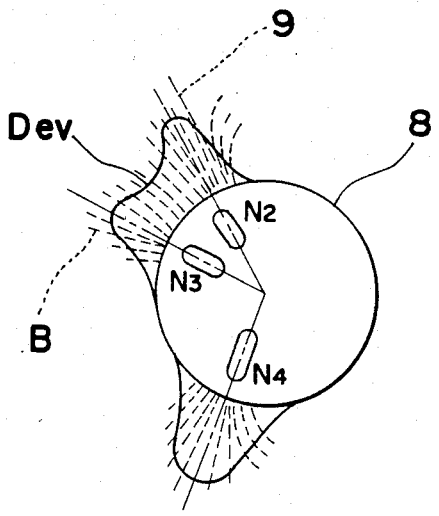
FIG. 3, is a view showing a developing sleeve employed in the developing device of FIG. 1, on which developer is partially held.

Meanwhile, magnetic force of the magnetic pole N3 is so set as to be slightly smaller than those of the magnetic poles N2 and N4. Radial angles formed between neighboring ones of the magnetic poles provided on the magnetic member 10 are set as shown in FIG. 2 and magnetic force is distributed on the developing sleeve 8 as shown in FIGS. 2 and 3. As shown in FIGS. 2 and 3, magnetic force produced, by the magnetic poles N2 and N3, at portions of the developing sleeve 8 confronting the magnetic poles N2 and N3 is continuously distributed in a range of 200 to 300 G (gauss). Therefore, lines B of magnetic force produced by the magnetic poles N2, N3 and N4 are distributed as shown by the broken lines of FIG. 3. Supposing that the bristle height regulating member 9 is not provided, developer Dev is held in a state shown in FIG. 3. Namely, at the portions of the developing sleeve 8 confronting the magnetic poles N2 and N3, a magnetic brush formed by the developer is erected substantially and is held in an approximately trapezoidal state as a whole such that peaks of the magnetic brush appear at the portions of the developing sleeve 8 confronting the magnetic poles N2 and N3.

The screws 11 and 12 are rotatably provided in the transport passages 5 and 6 so as to be driven for rotation thereof in the directions of the arrows b and c, respectively. The screws 11 and 12 are arranged to circulate, via the transport passages 5 and 6 and the openings communicating the transport passages 5 and 6, the developer accommodated in the transport passages 5 and 6. In the transport passage 5, a bristle cutting frame 13 is provided. In the bristle cutting frame 13, a pair of side plates 15 only one of which is shown in FIG. 1 are coupled, at one end thereof, with each other by a coupling plate 16 and a blade 17 is attached to the coupling plate 16. The side plates 15 are, respectively, rotatably supported by a pair of shafts 14 mounted on opposite side walls of the casing 2, which side walls are, respectively, disposed at a far side and a near side in the direction perpendicular to the sheet of FIG. 1. By a drive means (not shown), the bristle cutting frame 13 can be changed over to a state of FIG. 1 in which the bristle cutting frame 13 is retracted to a rear portion of the transport passage 5 and a state of FIG. 4 in which the coupling plate 16 and the blade 17 are disposed between the developing sleeve 8 and the screw 11 such that a distal end of the blade 17 is held in contact with the outer periphery of the developing sleeve 8.

The developing device 1 of the above described arrangement is operated as follows. At the time of development, the bristle cutting frame 13 is retracted to the rear portion of the transport passage 5. Thus, the developer is circulated through the transport passages 5 and 6 and is held on the developing sleeve 8 at the developer supply region X when the developer is conveyed through the transport passage 5. At the portions of the developing sleeve 8 confronting the magnetic poles N3 and N2, the developer supplied to the developing sleeve 8 is held in the state of the magnetic brush as shown in FIG. 3. While the developer is being carried in the direction of the arrow a upon rotation of the developing sleeve 8, the magnetic brush is regulated at the portion of the developing sleeve 8 confronting the bristle height regulating member 9 such that transport amount of the developer is adjusted. Meanwhile, the developer which has passed through the portion of the developing sleeve 8 confronting the bristle height regulating member 9 is brought into contact with the photosensitive drum 100 at a developing region Y so as to develop an electrostatic latent image into a visible image.

The developer which has passed through the developing region Y passes through the portions of the developing sleeve 8 confronting the magnetic poles S2 and N4 so as to reach the non-magnetic portion Z. At the non-magnetic portion Z, the developer is made free from magnetic force of the magnetic member 10 so as to be released from the outer periphery of the developing sleeve 8 and is mixed with the developer being conveyed through the transport passage 5. Meanwhile, since magnetic force of the magnetic pole N3 is set to a relatively small value as described earlier, such a phenomenon does not take place that the developer scraped from the developing sleeve 8 is attracted by the magnetic pole N3 so as to be adsorbed on the developing sleeve 8 again.

Figure 6:
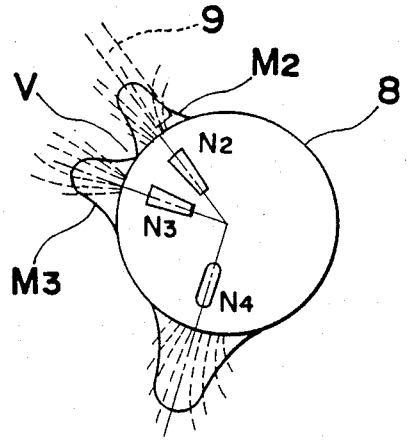

Meanwhile, when a distance between the magnetic poles N2 and N3 is made excessively large, crests M2 and M3 of the developer Dev are formed at locations corresponding to the magnetic poles N2 and N3, respectively as shown in FIG. 6 and a bottom V having no developer is formed between the crests M2 and M3. Hence, when the developer is displaced upon rotation of the developing sleeve 8 from the portion of the developing sleeve 8 confronting the magnetic pole N3 to the portion of the developing sleeve 8 confronting the magnetic pole N2, the developer jumps from the crest M3 to the next crest M2 and thus, is spaced away from the surface of the developing sleeve 8 so as to be subjected to no transport force of the developing sleeve 8 for a moment. Therefore, transport efficiency of the developer Dev is aggravated. Furthermore, amount of the developer carried to the developing region Y through the portion of the developing sleeve 8 confronting the bristle height regulating member 9 becomes nonuniform, thereby resulting in nonuniform image density.

However, in the present invention, even when the developer is conveyed from the magnetic pole N3 to the magnetic pole N2, the developer is retained on the developing sleeve 8. Therefore, transport efficiency of the developer is stabilized and amount of the developer conveyed to the developing region Y becomes constant, thereby resulting in prevention of non-uniform image density.

Figure 4:
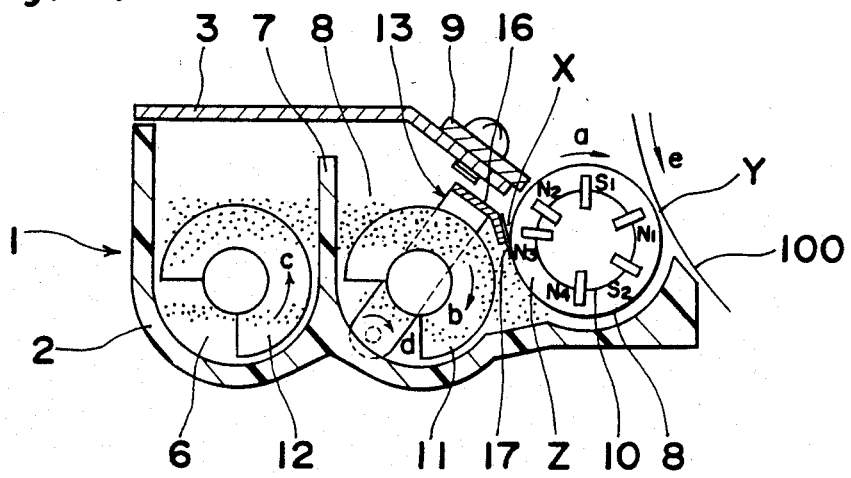
FIGS. 4 and 5 are sectional views showing operational states of the developing device of FIG. 1; and showing arrangement of magnetic poles different from that of FIG. 3.
Figure 5:
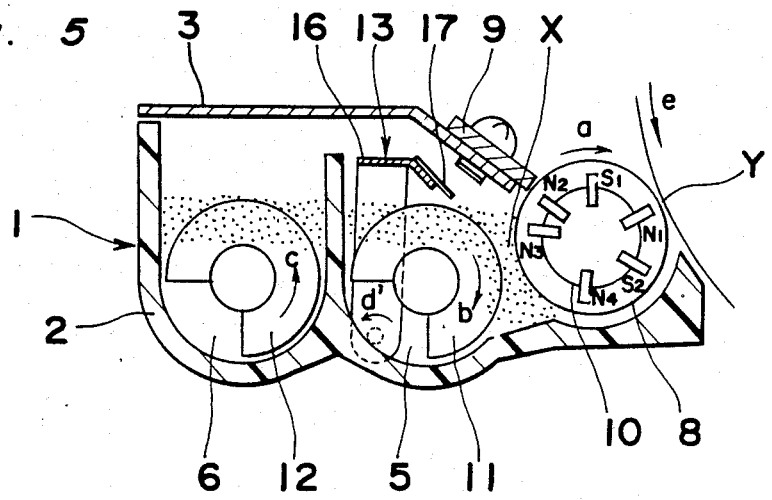

Subsequently, in order to change over the developing device 1 from the developing state to the nondeveloping state, the bristle cutting frame 13 is initially rotated in the direction of the arrow d as shown in FIG. 4 while the developing sleeve 8 and the screw 11 are being rotated, so that the coupling plate 16 and the blade 17 are displaced to the developer supply region X such that the distal end of the blade 17 is brought into, at an upstream side of the magnetic pole N3, with the outer periphery of the developing sleeve 8. As a result, supply of the developer to the developing sleeve 8 is cut off by the bristle cutting frame 13. Meanwhile, the developer held on the outer periphery of the developing sleeve 8 is carried in the direction of the arrow a and is separated from the surface of the developing sleeve 8 at the nonmagnetic portion Z, so that a state is brought about in which no developer exists in the developing region Y. Then, after drive of the developing sleeve 8 and the screw 11 has been stopped, the bristle cutting frame 13 is retracted away from the developing sleeve 8 as shown in FIG. 5. Hence the developer disposed in the vicinity of the developer supply portion X is attracted by the magnetic pole N3 so as to be held, in an erect and continuous state along the magnetic field formed by the magnetic poles N2 and N3, on the outer periphery of the developing sleeve 8, so that the developing device 1 is set to the nondeveloping state. Meanwhile, the developer is held on the surface of the developing sleeve 8 uniformly in the axial direction in a state where the developer has uniform distal end portions.

Subsequently, when the screws 11 and 12 and the developing sleeve 8 are rotated, the developer retained by the magnetic pole N3 is transported, as a front end of the developer, in a substantially laterally linear state in the direction of the arrow a so as to be conveyed to the developing region Y through the portion of the developing sleeve 8 confronting the bristle height regulating member 9. Meanwhile, since bristle of the substantially erect magnetic brush of the developer is cut at the portion of the developing sleeve 8 confronting the bristle height regulating member 9, amount of the developer transported to the developing region Y becomes constant. Furthermore, since the developer is not adsorbed to the outer periphery of the developing sleeve 8 after start of rotation of the developing sleeve 8 but transport of the developer to the developing region Y has been already started at the time of start of rotation of the developing sleeve 8, the developer is rapidly used for development.

In the foregoing description, the bristle height regulating member 9 is disposed at the location confronting the magnetic pole N2 so as to cut bristle of the erect magnetic brush of the developer. However, the bristle height regulating member 9 may also be disposed at a location confronting an intermediate portion of the developing sleeve 8 between the neighboring magnetic poles so as to cut bristle of the magnetic brush between the neighboring magnetic poles.

As is clear from the foregoing, in the developing device of the present invention, a time period from start of the developing operation to start of stable supply of the developer to the developing region is quite short and the stable developing operation is started rapidly.

Accordingly, if the developing device of the present invention is applied to an image forming apparatus in which a multi-color image is formed by driving a plurality of the developing devices during one copying operation, image density of boundary portions of the copying regions becomes stable and a high-quality image having uniform density can be obtained.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A developing device comprising:

a developing sleeve rotatably provided in the vicinity of an electrostatic latent image support member;

a supply means for supplying developer to the peripheral surface of said developing sleeve;

a bristle height regulating member for regulating amount of the developer transported, according to rotation of said developing sleeve, on the peripheral surface of said developing sleeve towards a developing region where said developing sleeve confronts said electrostatic latent image support member;

a removal means for removing from the peripheral surface of said developing sleeve the developer having passed through the developing region;

a cutoff member for cutting off supply of the developer from said supply means to said developing sleeve, said cutoff member being so provided as to be retractably projected into a developer supply region defined between said developing sleeve and said supply means; and a magnet member which is fixedly provided in said developing sleeve and includes a developing magnetic pole confronting said electrostatic latent image support member, a first magnetic pole confronting said bristle height regulating member and a second magnetic pole confronting the developer supply region, said second magnetic pole having a polarity identical with that of said first magnetic pole such that the developer is continuously held in an erect state on said developing sleeve by said first and second magnetic poles.

2. A developing device as claimed in claim 1, wherein magnetic fields formed by said first and second magnetic poles are continuous.

3. A developing device as claimed in claim 1, wherein said removal means includes a third magnetic pole having a polarity identical with that of said second magnetic pole, said third magnetic pole being disposed upstream of said second magnetic pole in a direction of transport of the developer, with magnetic fields formed by said second and third magnetic poles being discontinuous.

4. A developing device as claimed in claim 1, wherein said cutoff member is a plate.

5. A developing device as claimed in claim 1, wherein said supply means is a screw member.

6. A developing device as claimed in claim 5, wherein said screw member includes first and second screws.

* * * * *